US008915171B2

(12) United States Patent
Gallucci

(10) Patent No.: US 8,915,171 B2
(45) Date of Patent: Dec. 23, 2014

(54) DEVICE FOR UNLOADING FLAT ARTICLES FROM A WORK PLANE, FLAT ARTICLES INCLUDING PORTIONS ON WHICH DESIGNS AND/OR WRITING IS REPRODUCED BY CUTTING AND/OR INCISION

(76) Inventor: Giuseppe Gallucci, Monte Urano (IT)

( * ) Notice: Subject to any disclaimer, the term of this patent is extended or adjusted under 35 U.S.C. 154(b) by 185 days.

(21) Appl. No.: 13/812,916

(22) PCT Filed: May 27, 2011

(86) PCT No.: PCT/IB2011/052342

§ 371 (c)(1),
(2), (4) Date: Jan. 29, 2013

(87) PCT Pub. No.: WO2012/017336

PCT Pub. Date: Feb. 9, 2012

(65) Prior Publication Data

US 2013/0125721 A1 May 23, 2013

(30) Foreign Application Priority Data

Aug. 6, 2010 (IT) ..... BO2010A0514

(51) Int. Cl.
*B26F 3/00* (2006.01)
*B26D 7/06* (2006.01)

(52) U.S. Cl.
USPC ..... 83/112; 83/177

(58) Field of Classification Search
USPC ..... 83/102, 111, 98, 100, 150–154, 112, 83/167, 177
See application file for complete search history.

(56) References Cited

U.S. PATENT DOCUMENTS 2,352,211 A * 6/1944 Kratzmaier ..... 83/146
3,580,120 A * 5/1971 Adams et al. ..... 83/98
3,732,762 A * 5/1973 Plumb ..... 83/98
3,771,396 A * 11/1973 Im ..... 83/98

(Continued)

FOREIGN PATENT DOCUMENTS

DE 102004062812 A1 7/2006
DE 102007020864 A1 11/2008
DE 202009014154 U1 1/2010
EP 1992456 A2 11/2008

OTHER PUBLICATIONS

International Search report for PCT/IB2011/052342, mailed Aug. 19, 2011, 3 pages.

*Primary Examiner* — Sean Michalski
(74) *Attorney, Agent, or Firm* — William J. Sapone; Ware Fressola Maguire & Barber LLP

(57) ABSTRACT

A device for unloading, from a work plane, flat articles having cut portions, the work plane having zones exhibiting first holes selectively connectable to a source of compressed air. A plate arranged horizontally and subdivided into sections exhibits second holes selectively connectable to an aspirating source. An activator vertically and horizontally moves the plate. A control and command board controls the activator, the compressed air source and the aspirating air source, for arranging the plate on the cut article positioned on the work plane and to connect the aspirating source (S) with at least one of the second holes (51) facing the article (A), and the compressed air source (Sc) with at least one of the first holes (29) covered by the article, to detach the article (A) from the work plane (2) and to engage the article to the plate (5).

11 Claims, 7 Drawing Sheets

(56) References Cited

U.S. PATENT DOCUMENTS

| | | | | | |
|---|---|---|---|---|---|
| 3,939,743 | A * | 2/1976 | Coombes | 83/98 |
| 4,371,103 | A * | 2/1983 | Siemens et al. | 225/1 |
| 4,377,097 | A * | 3/1983 | Calvano | 83/98 |
| 4,382,396 | A * | 5/1983 | Hawkins | 83/98 |
| 4,833,959 | A * | 5/1989 | Vietrogoski et al. | 83/404.2 |
| 4,912,959 | A * | 4/1990 | Bond | 72/426 |
| 5,314,523 | A * | 5/1994 | Ikola et al. | 65/112 |
| 5,810,233 | A * | 9/1998 | Varidel | 225/97 |
| 5,870,937 | A * | 2/1999 | Reis et al. | 83/24 |
| 5,894,773 | A * | 4/1999 | Sevenish et al. | 83/13 |
| 6,463,762 | B1 * | 10/2002 | Ross, Jr. | 65/105 |
| 8,146,385 | B2 * | 4/2012 | Delia et al. | 65/97 |
| 8,220,685 | B1 * | 7/2012 | Lindsey, Jr. et al. | 225/93 |
| 8,292,141 | B2 * | 10/2012 | Cox et al. | 225/2 |
| 2001/0003936 | A1 * | 6/2001 | Song | 83/24 |
| 2005/0226711 | A1 * | 10/2005 | Schnoor et al. | 414/736 |
| 2008/0264221 | A1 * | 10/2008 | Katsuyama | 83/151 |
| 2012/0073417 | A1 * | 3/2012 | Ujiie et al. | 83/24 |
| 2014/0165806 | A1 * | 6/2014 | Gallucci | 83/152 |

* cited by examiner

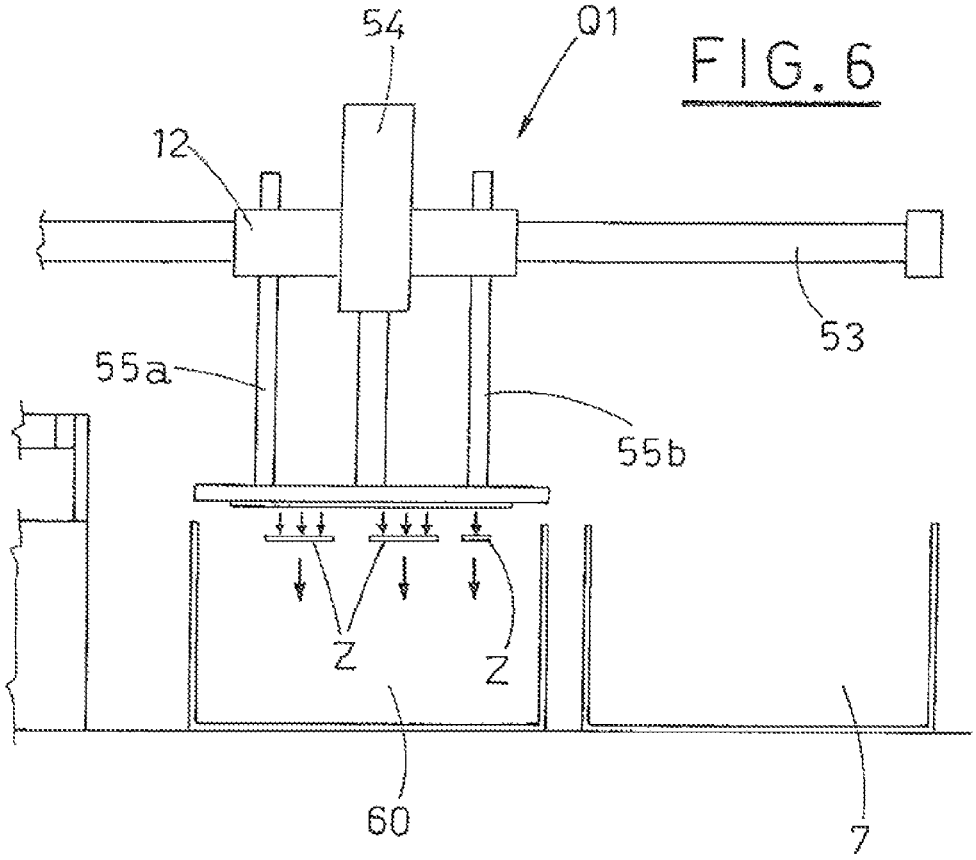
FIG. 6
FIG. 7
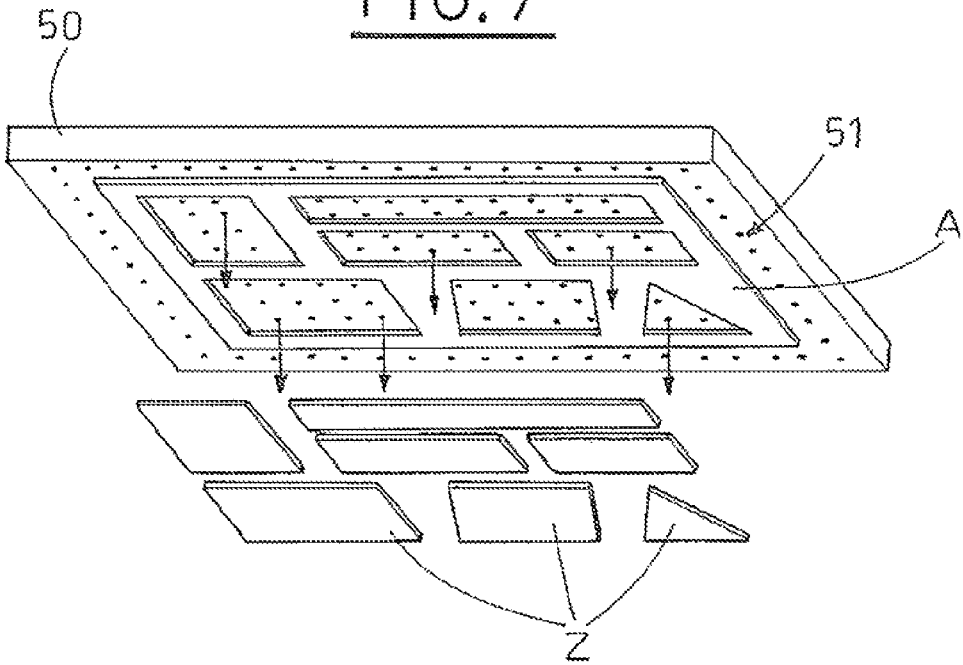

DEVICE FOR UNLOADING FLAT ARTICLES FROM A WORK PLANE, FLAT ARTICLES INCLUDING PORTIONS ON WHICH DESIGNS AND/OR WRITING IS REPRODUCED BY CUTTING AND/OR INCISION

CROSS REFERENCE TO RELATED APPLICATIONS

This application is a national stage of PCT International patent application Ser. No. PCT/IB2011/052342, filed 27 May 2011, claiming priority in Italian patent application no. BO2010A 000514.6, filed 6 Aug. 2010, the contents of which are hereby incorporated by reference.

FIELD OF THE INVENTION

The present Invention relates to the technical sector relating to the unloading, from a work plane, of flat articles in which portions on which designs and/or writing is reproduced by cutting and/or incision.

DESCRIPTION OF THE PRIOR ART

A device is known which comprises, in cascade: a loading magazine, in which flat articles to be cut and/or incised are stacked; a work plane for a cutting unit; a collecting magazine for the previously-cut and/or incised flat articles on the work plane by means of the cutting unit. It is to be noted that the cut and/or incised portions are anchored to the cut parts by appendages.

A horizontal frame is arranged on the work plane and the collecting magazine, which horizontal frame is moved longitudinally in outward and return runs.

First and second gripping means are constrained to the two transversal heads of the frame, which gripping means are constituted, for example, by batteries of suckers or plier organs, on which operating and non-operative configurations are set.

On termination of the return run the first gripping means are positioned at the transversal edge, situated downstream, of the head article in the stack in the loading magazine, while the second means are arranged at the transversal edge, located downstream, of the flat article situated on the work plane.

With the activation of the first and second means, to define the above-mentioned operating configurations, and the performing by the frame of the outward run, a new article is positioned on the work plane and, at the same time, the article bearing the cuts and/or the incisions is arranged on the collecting magazine.

The non-operating configuration of the first and second means involves the resting of an article on the work plane and the fall of the cut and/or incised article into the collecting magazine.

The device used for unloading the cut and/or incised articles exhibits some drawbacks.

The first and second gripping means of the article to be cut and/or incised are associated to a single frame, such that any eventual malfunctioning of the first or second gripping means lead to a temporary interruption of the operating cycle of loading, cutting, unloading as described above.

The described device enables collecting/positioning/unloading of flat articles, where the cut and/or incised portions, as mentioned above, are anchored to the waste by means of the appendages.

The eventual detachment of the cut and/or incised portions from the waste during the drawing of the article from the work plane to the collecting magazine leads to various drawbacks, for example the detachment of one or more cut and/or incised portion from the article, including partial detachment.

This detachment obstructs both the alignment of the flat article during advancing of the article on the plane and compromises the stacking thereof in the collecting magazine.

This leads to a constant presence of an operator who when needed will have to intervene to remove the article involved in the faulty functioning from the device.

SUMMARY OF THE INVENTION

The aim of the invention is to disclose a device for unloading, from a work plane, flat articles which exhibit, by cutting and/or incision, portions on which designs and/or writing are reproduced, which device obviates the drawbacks cited herein above; in particular the invention provides a device which enables easy collection of the cut and/or incised article from the work plane and stabilizes the mutual positioning between the portions and the waste during the collecting of the article from the work plane and the following transfer of the article into a collecting magazine.

A still further aim of the invention is to provide a device which enables collection of a cut and/or incised flat article from a work plane and unloads the cut and/or incised portion and the waste from the article into separate magazines.

A further aim of the invention is to provide a device for unloading flat articles which is separate from the gripping systems provided for collecting the articles from the loading magazine and the positioning thereof on the work plane.

A still further aim of the invention is to provide a device for unloading cut and/or incised articles a functioning of which does not require constant control on the part of an operator.

The above-mentioned aims are obtained in accordance with the contents of the claims.

BRIEF DESCRIPTION OF THE DRAWINGS

The characteristics of the invention will emerge from the following description, which describes a preferred but not exclusive embodiment thereof, with reference to the tables of the drawings, in which:

FIG. 6 is a schematic lateral view, with some parts removed, of the device of the invention, in a second embodiment thereof;

FIG. 7 illustrates a perspective view from below of the engaging/release organ of the flat article, with the detaching of the waste of the cut and/or incised portions evidenced;

DESCRIPTION OF PREFERRED EMBODIMENTS

Figure 1:
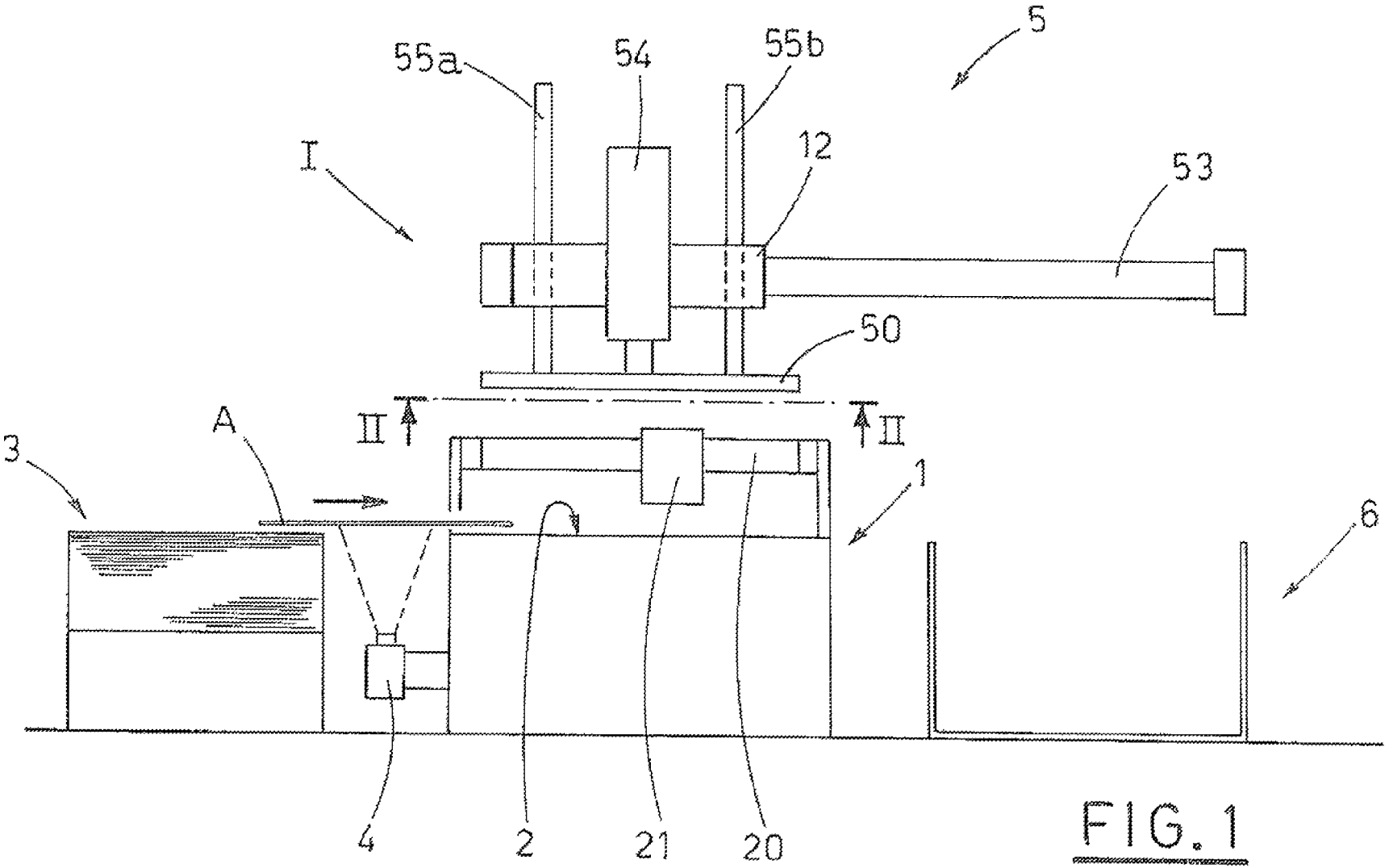
FIG. 1 is a schematic lateral view of the device in a first embodiment thereof.

With reference to the accompanying figures of the drawings, 1 denotes a cutting group comprising a work plane 2 on which flat articles to be cut and/or incised are positioned restingly: the work plane 2 is defined by zones interested by first holes 29 connectable selectively to a source of compressed air Sc.

The work plane 2 is surmounted by a portal 20 to which a guide is associated, which slidably bears a cutting unit 21 for cutting and/or incising, according to known methods, the flat articles resting on the work plane 2.

An optical device is fixed laterally to the structure of the work plane 2, which is orientated in an upwards direction such as to detect the dimensions of each article to be cut and the designs and/or writing to be reproduced on the lower surface of the said article A in arrival from a loading magazine 3, located upstream, of the cutting group 1; this data is used to move the machine 21 such as to cut and/or incise the desired portions of the article A; all of this is in accordance with PCT International publication no. WO2011/045729, published 21 Apr. 2011, owned by the present applicant.

A guide support 53 is located superiorly of the cutting group 1 and of a collecting magazine 6, and downstream of the latter; the guide support 53 is constituted by a horizontal bar, on which a device 5 is mobile for unloading, from the work plane, flat articles in which portions are fashioned by cutting and/or incision, on which designs are reproduced and/or writings.

The unloading device 5 is defined by a slide 12 which bears an actuator 54 that moves a plate guided by two vertical stems 55*a*, 55*b* vertically between two endrun positions.

Figure 3:
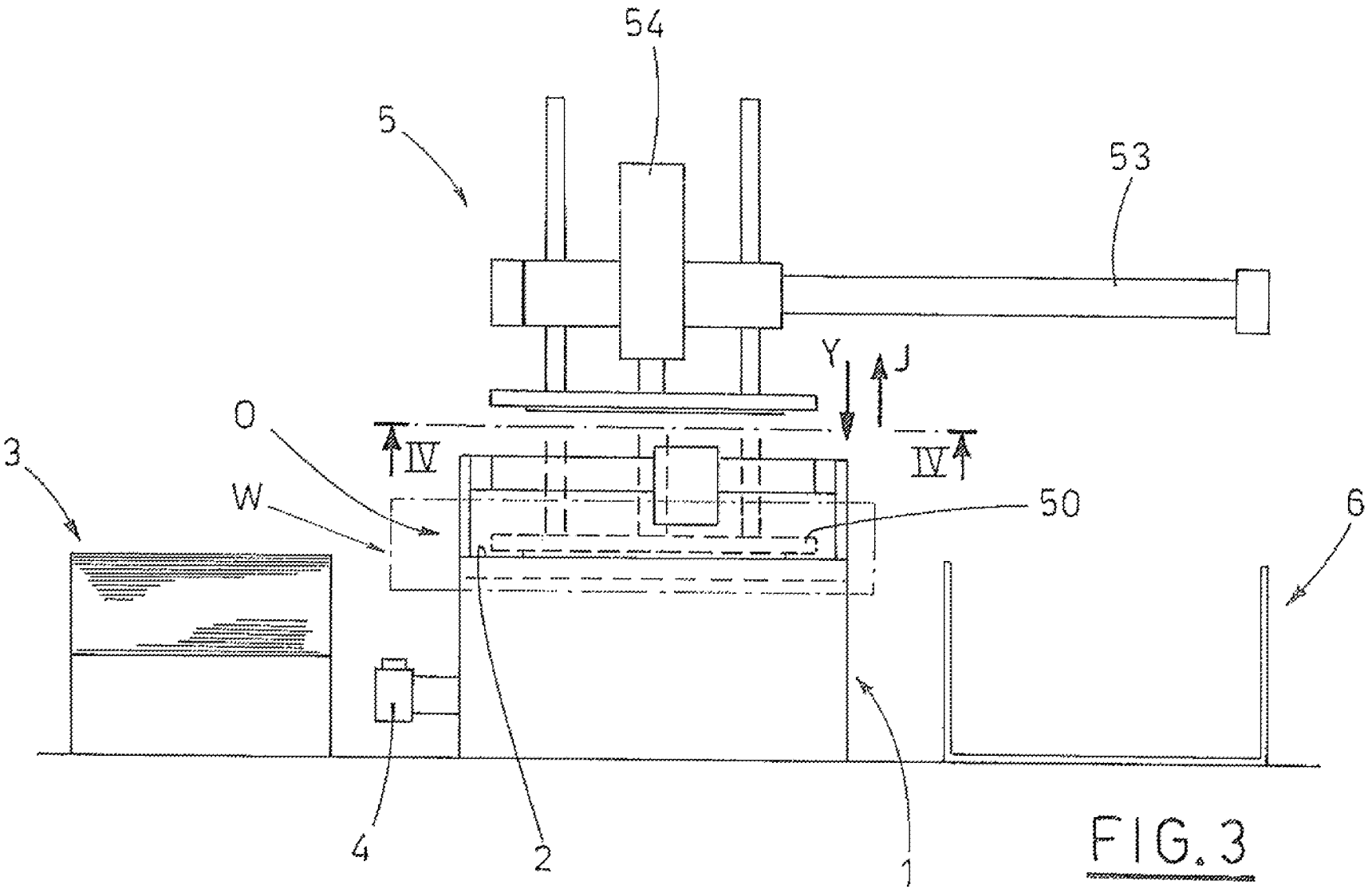
FIG. 3 is the view of FIG. 1, with a first position of the device of the invention represented in a broken line.
Figure 3A:
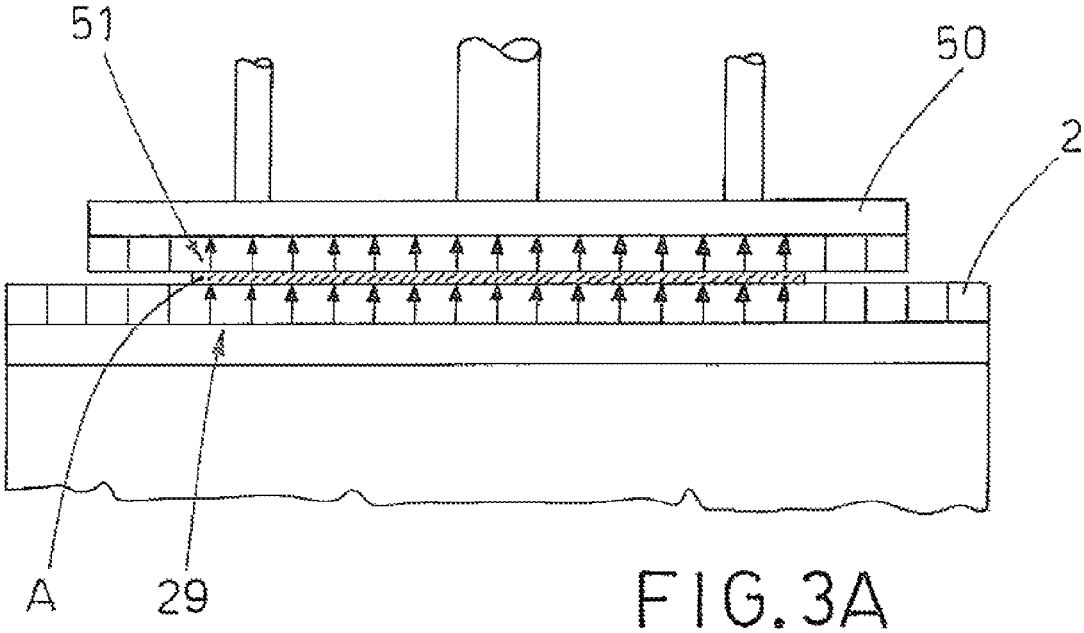
FIG. 3A illustrates a sectioned view of detail W of FIG. 3.
Figure 3B:
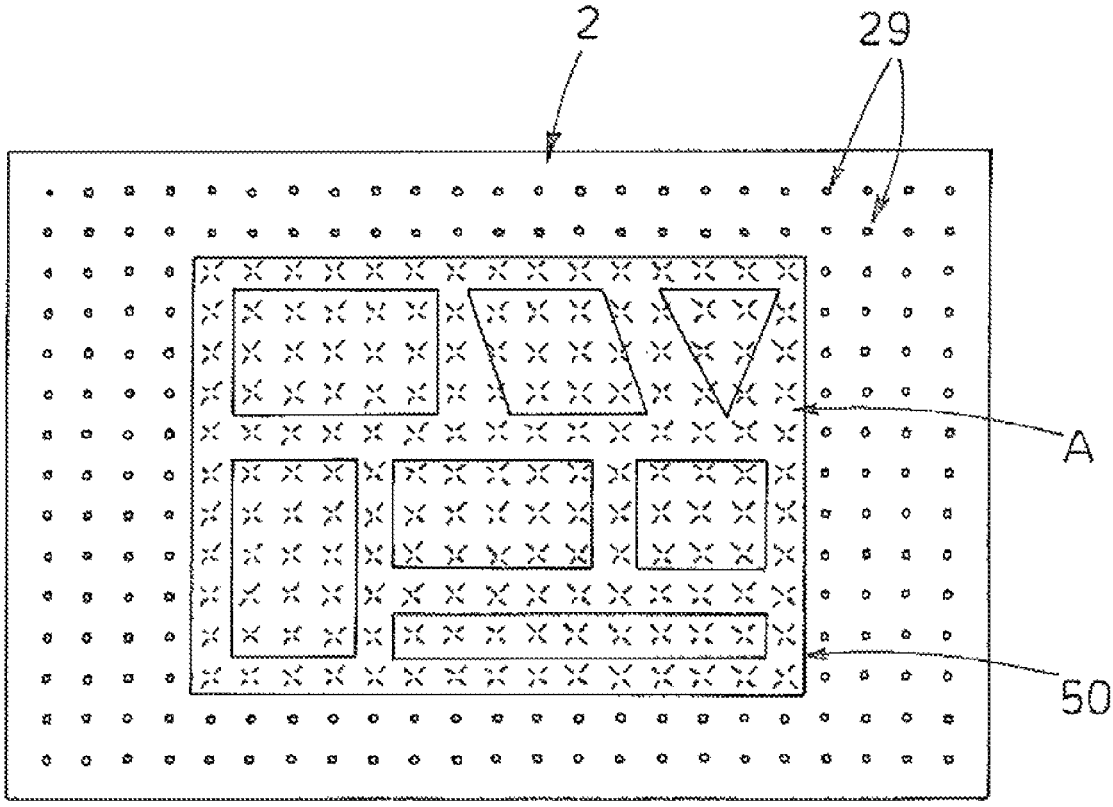
FIG. 3B illustrates a view from above of a work plane, on which a cut and/or incised article A is positioned.
Figure 3C:
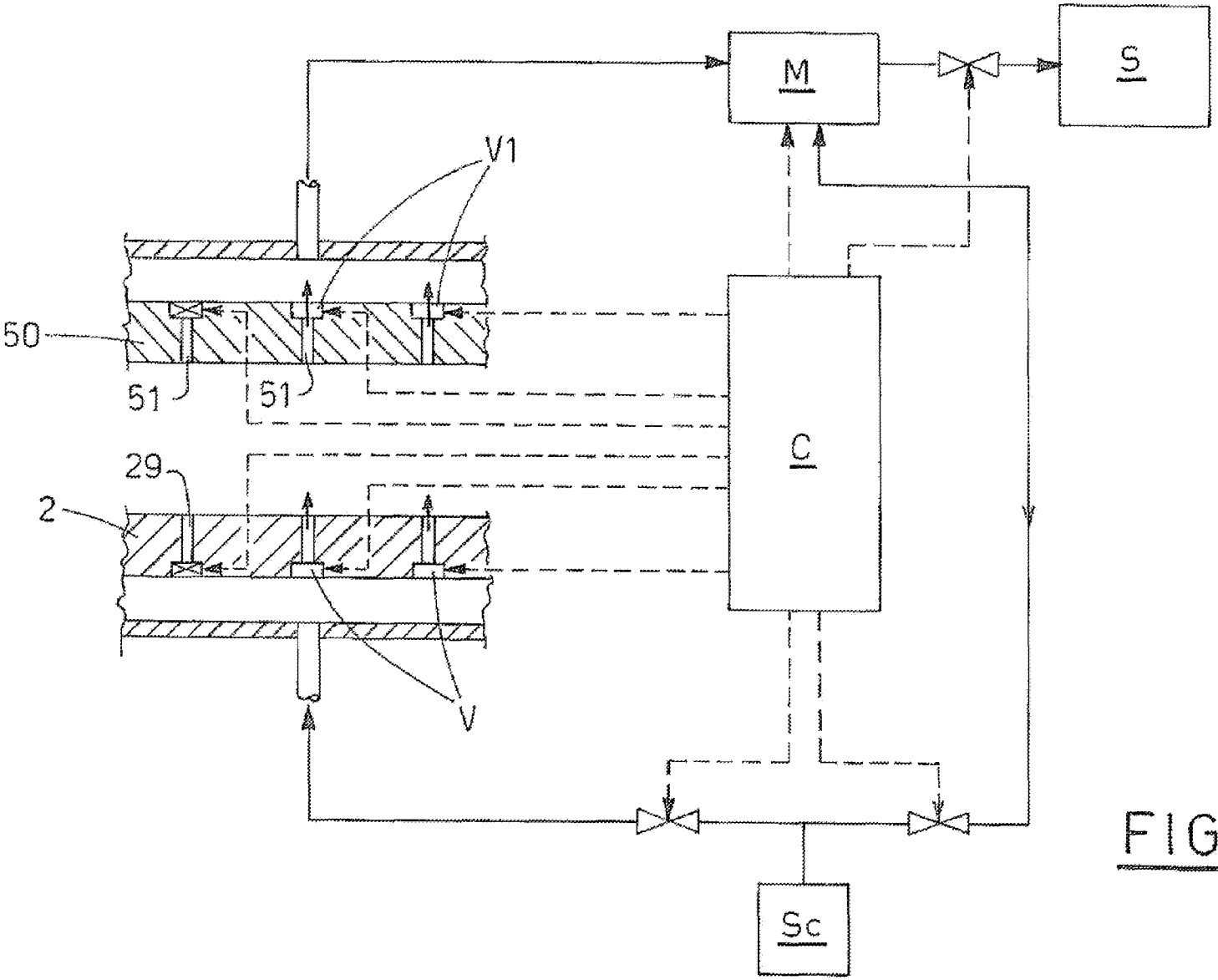
FIG. 3C is a schematic view of the connection between a control and command board, the device and the work plane.
Figure 2:
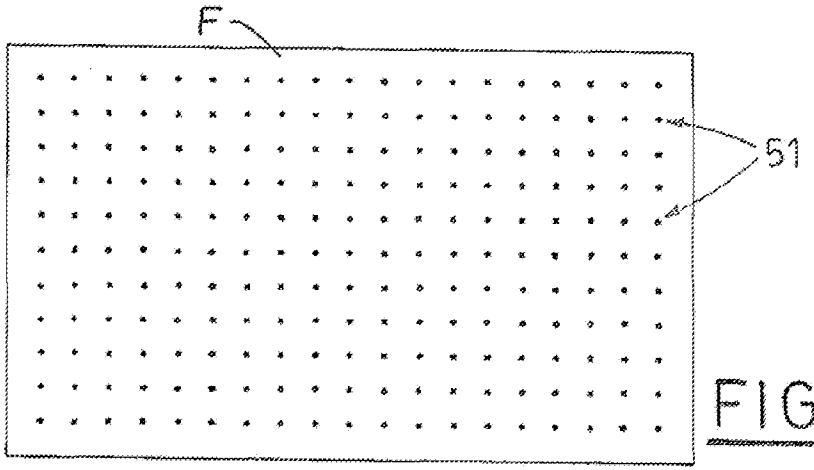
FIG. 2 is a view of section II-II of FIG. 1.
Figure 4:
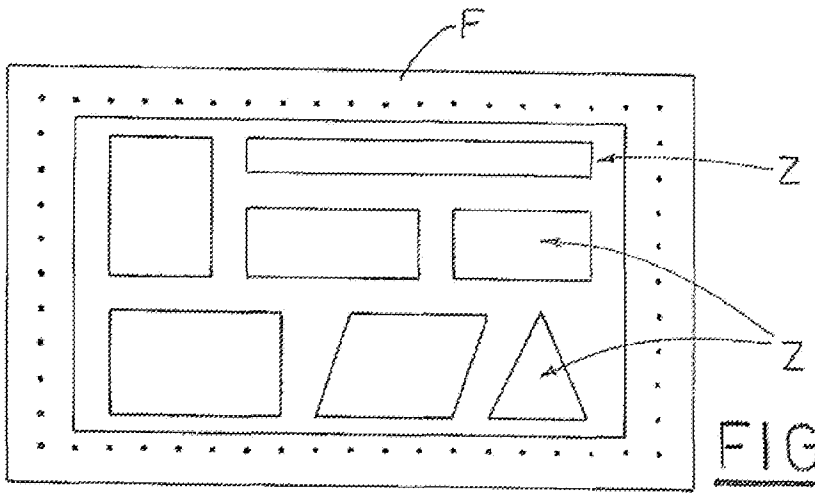
FIG. 4 is a view of section IV-IV of FIG. 3.

The lower surface F of the plate 50 is sub-divided into sections affording second holes 51 opening into the said lower surface, the second holes being connectable either to an aspirating source S or a source of compressed air Sc, as schematically illustrated in FIG. 3C.

The source of compressed air Sc, the aspirating source S and the activating means for vertical and horizontal movement of the plate 50 are commanded by a command and control board C.

There now follows a description of the functioning of the device of the invention.

A series of flat articles A are stacked in the loading magazine 3 in such a way that, for example, the flat surface on which the designs and/or writings are reproduced faces downwards.

Gripping systems, not illustrated, are comprised downstream of the loading magazine 3, which collect the head article of the stack of articles and arrange it on the work plane 2 of the cutting unit 1.

The optical device 4, during the displacement of each article A, detects the dimension of the article A and the designs and/or writings which are on the flat surface of the article, and then activates, in a known way, the cutting and/or incision unit 21 such as to obtain the portions Z desired.

Following the positioning of the article A and the cutting and/or incision thereof, the unloading device 5 overlying the work plane 2 passes (towards y in FIG. 3) from a non-operating position (FIG. 1), in which the plate 50 is raised with respect to the work plane 2, to a first position O (illustrated in a broken line in FIG. 3) in which the plate 50 is lowered with the relative lower surface adhering on the article A that has been cut and/or incised resting on the work plane 2.

The control and command board C, in phase relation with the first position O imposed on the plate 50, connects the source of compressed air Sc by activation of known first valves V, to the first holes 29 covered by the surface of the cut and/or incised article A, and connects the aspirating source S by activation of known second valves V1, to the second holes 51 facing the same surface of the article A.

It follows that the lower surface of the article A is subjected to a blowing action from below in an upwards direction (FIG. 3A) such as to facilitate the detachment of the article from the work plane 2, and the upper surface is subjected to the aspirating action of the plate 50: the article A, with the cut portions Z and the relative waste R, is engaged by the plate 50 and maintained in adherence thereto.

The plate 50 displaces in an upwards direction in the direction of the arrow J of FIG. 3 and in phase relation with this displacement the first holes 29 of the zones interested by the surface of the article A are, by means of deactivation of the first valves V, disconnected from the corresponding source of compressed air Sc.

Figure 5:
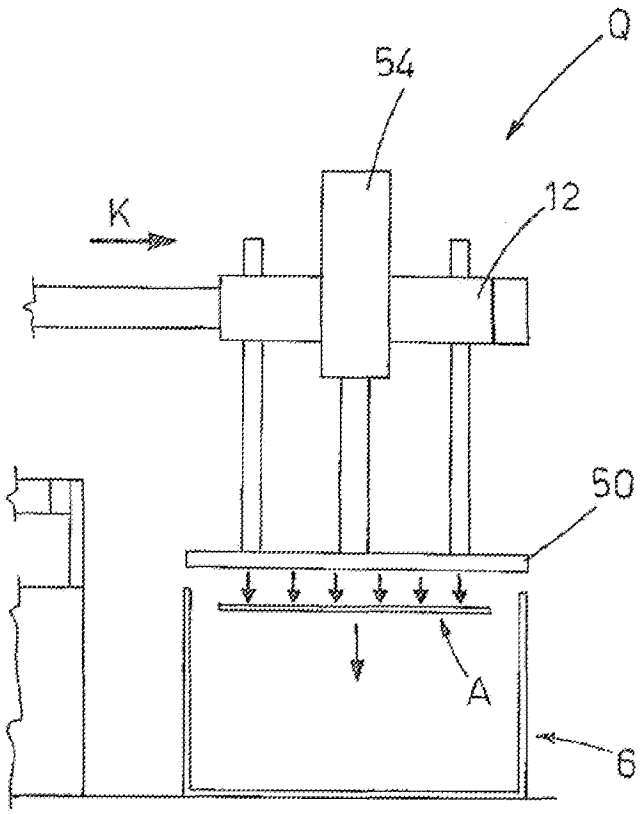
FIG. 5 is a schematic lateral view, with some parts of the device removed, with the second position of the article in evidence.
Figure 8:
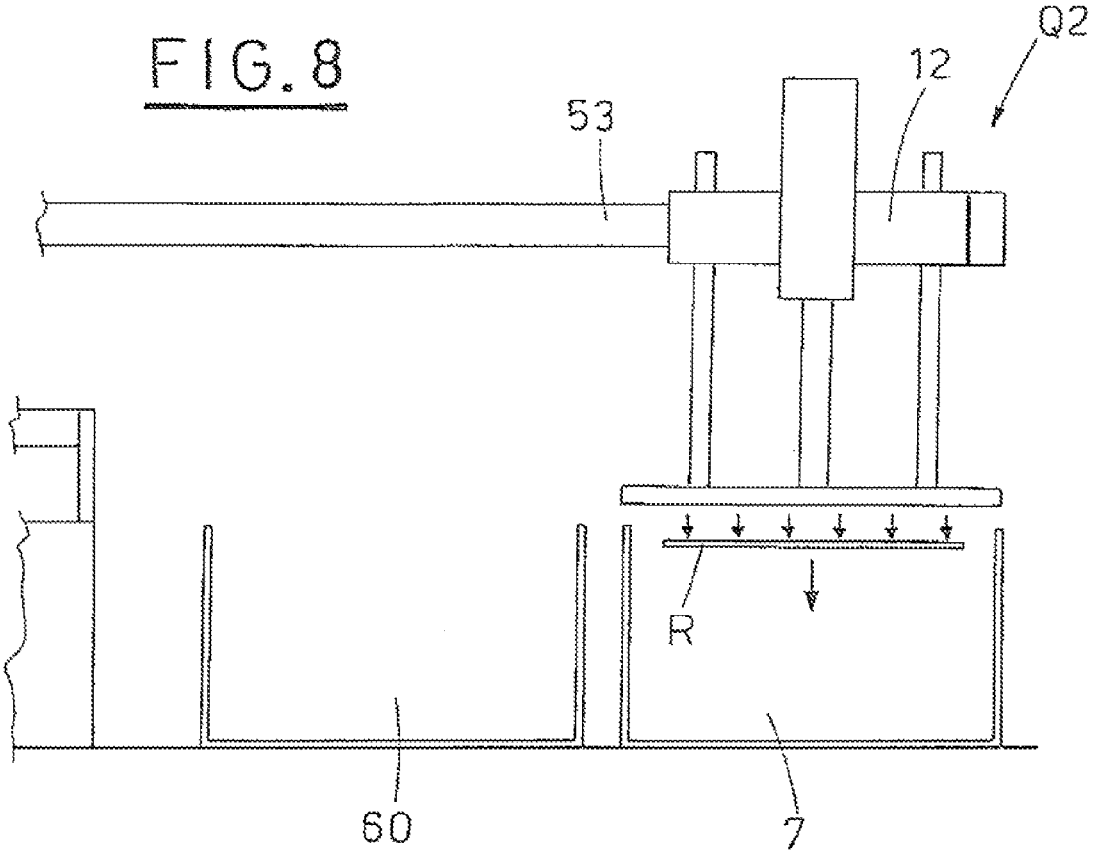
FIG. 8 is the same view as FIG. 6, with a third position of the device of the invention evidenced.
Figure 9:
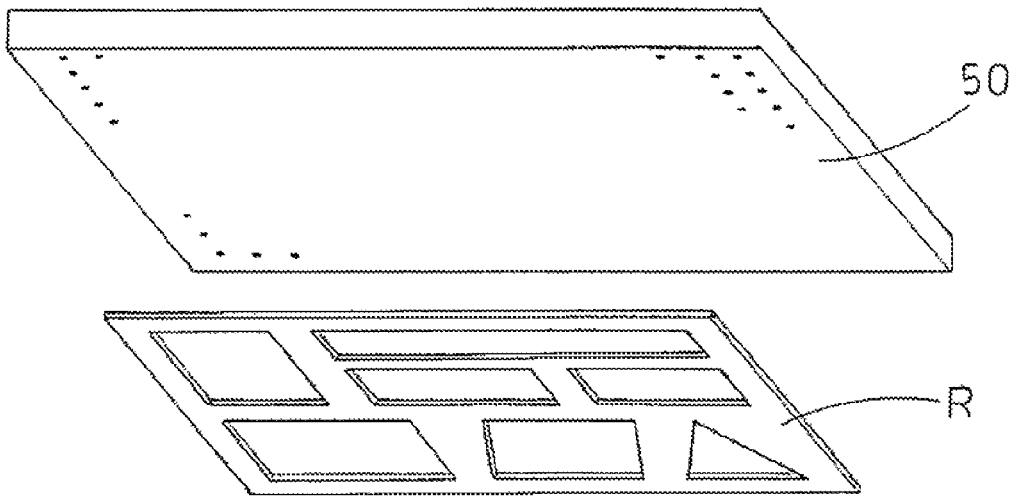
FIG. 9 is a perspective view from below of the engaging/release organ of the flat article, with the detachment of the waste of FIG. 8 evidenced.

The slide 12 moves along the guide support 53 (in the direction of the arrow K of FIG. 5) up to positioning the plate 50 and the cut and/or incised article supported thereby on the collecting magazine 6 such as to define a second position Q.

The plate 50 newly displaces downwards, the second holes 51 facing the surface of the cut and/or incised article are, by activation of the switches M subjected to the control board C, disconnected from the aspirating source S, in phase relation with the definition of the second position Q of the plate 50, and connected to the compressed air source Sc: the flow of air generated facilitates the detachment of the cut and/or incised article from the plate 50 with a consequent falling of the article into the collecting magazine 6.

The unloading device 5 is again arranged on the work plane 2, in a non-operative position I, such as to collect/displace/unload further articles to be cut and/or incised from the work plane 2 to the collecting magazine 6.

FIGS. 6, 7, 8, 9 illustrate the second embodiment of the proposed device.

As illustrated in FIG. 6, downstream of the cutting group 1 are a first and a second collecting magazine 60, 7, respectively for receiving the cut and/or incised portions Z and for receiving the waste R of the cut article.

The plate 50, following the cut and/or incision of the article A, engages the cut and/or incised article and is positioned on the first collecting magazine 60 such as to define a third position Q1 thereof as previously described for the second position Q of the plate; if needed a descent for the plate 50 can be provided in accordance with the level of the stack of portions Z present in the magazine 60.

The second position Q assumed by the plate 50, described for the first embodiment of the device, coincides with the third position Q1 assumed by the plate in the second embodiment.

The second holes 51 corresponding to the surfaces of the cut portions Z are, by means of activation of the switches M, disconnected from the aspirating source S, in phase relation with the third position Q1 of the plate 50, and connected to the source of compressed air Sc (FIG. 7): the flow of air generated facilitates the detachment of the cut and/or incised portions Z from the plate 50 with the consequent falling of the portions into the first collecting magazine 60.

The slide 12 subsequently slides along the guide 53 in order to bring the plate 50 into a fourth position Q2, in which the plate is located above the second collecting magazine 7 when required the plate is moved vertically downwards according to the level of the stack of waste R in the second collecting magazine 7.

By activation of the switches M, the second holes 51 corresponding to the surface of the waste of the cut and/or incised article A are disconnected from the aspirating source S and connected to the compressed air source Sc (FIGS. 8, 9): the flow of air generated facilitates the detachment of the waste R from the plate 50 with a consequent falling thereof into the second collecting magazine 7.

Following the unloading of the cut portions Z and the waste R into the respective collecting magazines 60, 7, the device 5 is newly arranged in the non-operative position I above the work plane 2 such as to collect/displace/unload further articles to be cut and/or incised.

The present device is particularly advantageous thanks to its constructional simplicity.

The article A, following the positioning thereof on the work plane 2, is subjected to atmospheric pressure which, combined with the rigidity of the material constituting it, determines a perfect adherence of the article on the work plane 2 during the cutting operation.

The activation of the! source of compressed air Sc connected to the first holes 29 of the work plane 2 and the contemporaneous activation of the aspirating source S connected to the second holes 51 of the plate 50 are advantageous as the flow of air generated by the source of compressed air Sc facilitates the detachment of the cut and/or incised article A from the work plane 2, thus avoided the "sticking" effect of the article A on the work plane, and the aspirating action of the plate 50 guarantees the adhering engaging of the article A, with the cut portions Z and the relative waste R, to the plate.

Alternatively to the what is described above, the control board C intervenes to connect only a fraction of the second holes 51 facing the article A to the aspirating source S and to connect Sc only a part of the first holes 29 covered by the article to the source of compressed air.

The device 5 overlies the work plane 2 such as to displace along the guide support 53 above the collecting magazine or magazines: this positioning facilitates the collecting of the cut and/or incised articles from the work plane 2 and their positioning in the collecting magazine and/or magazines, as previously described.

The position of the device 5 with respect to the cutting group 1 does not interfere with the function of the optical means 4, for detecting the dimensions of the article A and the designs and/or writings reproduced on the surface of the articles A, and does not disturb the functioning of the cutting unit 21.

The use of the aspirating source S, in combination with the use of the compressed air source, guarantee the correct collecting of the cut and/or incised flat article, both in the case in which the cut and/or incised portions Z are joined to the waste of the article by the appendages, and when they are completely detached from the waste of the article.

The action of the aspirating source S, during the displacement of the cut and/or incised article from the work plane to the collecting magazine(s), prevents detachment of one or more cut portions from the waste of the article, guaranteeing correct stacking in the collecting magazine(s).

The action of the source of compressed air Sc, with the contextual total or partial disconnection of the aspirating source S from predefined second holes 51, facilitates either the release of the cut and/or incised article, or the separate release of the cut portions Z and the waste R of the article into the corresponding magazines.

The device 5 is independent of the gripping means provided upstream of the cutting unit 1, and for this reason a malfunctioning of the gripping means has no effect on the movement of the articles following the cutting and/or incision thereof.

It is worthy of note that the unloading of the article from the plate is facilitated by the weight thereof: it follows that the number of the second holes which are connected to the source of compressed air Sc can be smaller with respect to those previously connected to the aspirating source S; similar considerations are valid for the unloading of the portions Z and the waste R as for the second embodiment.

In an advantageous variant of the proposed solution, following the positioning of the article to be cut on the work plane 2, the control board intervenes to connect the aspirating source S with at least a fraction of the first holes 29 covered by the article; following the cutting operation of the article A the control board C activates the switches M such as to switch the connection of the first holes 29 from the aspirating source S to the compressed air source Sc, then proceeding in the way described above.

The above has been described by way of non-limiting example, and any eventual modifications to details thereof, and also any variations in shape and dimensions of the described components are understood to fall within the same ambit of protection as claimed herein below.

The invention claimed is:

1. A device for unloading flat articles having portions fashioned by cutting from a work plane, the portions having designs or writings reproduced thereon, the device comprising:

a loading magazine (3) in which flat articles to be cut are stacked;

a transferring device for transferring a flat article (A) located at a head of a stack from the loading magazine (3) to the work plane (2);

a cutting unit (21) cooperating with the work plane (2), for cutting the article (A) resting thereon;

at least one collecting magazine;

wherein the work plane is defined by zones, each zone having at least one first hole (29), the first holes being selectively connectable to a compressed air source;

a plate 50, arranged horizontally, and being subdivided into sections, each section including a second hole (51) opening into a lower surface of the plate (50), the second holes (51) being selectively connectable to an aspirating source (S);

an activator for vertically and horizontally moving the plate to a first position (O) in which the lower surface of the plate adheres to the cut article situated on the work plane, and a second position (Q) in which the plate is situated above the collecting magazine;

a control and command board (C) for controlling the activator, the compressed air source (Sc) and the aspirating source (S), for connecting, in phase relation with the first position (O), the aspirating source (S) with at least one or more of the second holes (51) facing the article (A), and the source of compressed air (Sc) with at least one or more of the first holes (29) covered by the article, and to subsequently direct the raising of the plate (50), actuated in phase relation with the disconnecting of the first holes (29) from the source of compressed air (Sc), with a consequent engaging of the article to the plate (5), so as to position the plate (5) in a second position (Q), and finally to disconnect the second holes (51) from the aspirating source, with a consequent release of the cut article (A) from the plate.

2. The device of claim 1, further comprising switches (M) directed by the control board (C) to switch the connection of the second holes (51) from the aspirating source (S) to the source of compressed air (Sc), the switches (M) being activated in phase relation with the plate (50 reaching the second position).

3. The device of claim 2, further comprising two collecting magazines (60, 7), respectively a first collecting magazine and a second collecting magazine, for respectfully receiving portions (Z) cut from the article, and waste (R) corresponding thereto;

the activator positioning the plate in a third position (Q1) and a fourth position (Q2), situated respectively above the first collecting magazine and the second collecting magazine, the control board (C) deactivating, in phase relation with the third position (Q1) of the plate (50), the connection of the second holes facing the portions (Z) with the aspirating source (S) and consequently releasing the portions from the plate (50), the control board also deactivating, in phase relation with the fourth position (Q2) of the plate, the connection of the second holes facing the waste (R) with the aspirating source (S), with a consequent release of the waste (R) from the plate.

4. The device of claim 3, wherein the switches (M), in phase relation with the third position (Q1) of the plate (50), deactivate the connection of the second holes facing the portions (Z) from the aspirating source (S) and connect the second holes (51) to the source of compressed air (Sc), with a consequent release of the portions from the plate (50).

5. The device of claim 3, wherein the switches (M), in phase relation with the fourth position (Q2) of the plate (50), deactivate the connection of the second holes facing the waste (R) from the aspirating source (S) and connect the second holes (51) to the source of compressed air (Sc), with a consequent release of the waste (R) from the plate (50).

6. The device of claim 1, wherein the activator comprises:

a guide support (53);

a slide (12), supported and horizontally guided on the guide support (53);

an actuator (54) borne by the slide (12) to move the plate (50) horizontally and vertically.

7. The device of claim 6, wherein the activator further comprises two vertical stems (55*a*, 55*b*), constrained inferiorly to the plate (50) and slidably guided by the slide (12).

8. The device of claim 6, wherein the guide support (53) is a bar.

9. The device of claim 3, wherein the activator comprises:

a guide support (53);

a slide (12), supported and horizontally guided on the guide support (53);

an actuator (54) borne by the slide (12) to move the plate (50) horizontally and vertically.

10. The device of claim 9, wherein the activator further comprises two vertical stems (55*a*, 55*b*), constrained inferiorly to the plate (50) and slidably guided by the slide (12).

11. The device of claim 9, wherein the guide support (53) is a bar.

* * * * *